US011684132B2

(12) United States Patent
Bonnemaire et al.

(10) Patent No.: US 11,684,132 B2
(45) Date of Patent: Jun. 27, 2023

(54) DEVICE FOR TREATING THE HAIR FOR CONTROLLING THE APPLICATION OF A PRODUCT

(71) Applicants: L'OREAL, Paris (FR); SEB S.A., Ecully (FR)

(72) Inventors: Baptiste Bonnemaire, Lyons (FR); Martial Maisonneuve, Villefontaine (FR); Fabien Normand, Vienne (FR); Régis Fereyre, Lyons (FR); Xavier Vacheron, Genas (FR); Sandy Lapize, Saint-Ouen (FR); Gabin Vic, Saint-Ouen (FR); Stefania Nuzzo, Saint-Ouen (FR); Edouard Messager, Clichy (FR)

(73) Assignees: L'OREAL, Paris (FR); SEB S.A., Ecully (FR)

( * ) Notice: Subject to any disclaimer, the term of this patent is extended or adjusted under 35 U.S.C. 154(b) by 807 days.

(21) Appl. No.: 15/541,241

(22) PCT Filed: Dec. 24, 2015

(86) PCT No.: PCT/EP2015/081252
§ 371 (c)(1),
(2) Date: Jun. 30, 2017

(87) PCT Pub. No.: WO2016/107828
PCT Pub. Date: Jul. 7, 2016

(65) Prior Publication Data

US 2017/0340082 A1 Nov. 30, 2017

(30) Foreign Application Priority Data

Dec. 30, 2014 (FR) ..... 1463436

(51) Int. Cl.
*A45D 1/04* (2006.01)
*A45D 2/00* (2006.01)
(Continued)

(52) U.S. Cl.
CPC ..... *A45D 1/04* (2013.01); *A45D 1/28* (2013.01); *A45D 2/001* (2013.01); *A45D 24/00* (2013.01);
(Continued)

(58) Field of Classification Search
CPC ..... A45D 2/001; A45D 2/002; A45D 2/40; A45D 2001/002; A45D 2001/008;
(Continued)

(56) References Cited

U.S. PATENT DOCUMENTS 4,830,030 A * 5/1989 Busch ..... A45D 19/00 132/108
5,223,694 A 6/1993 Tsuji et al.
(Continued)

FOREIGN PATENT DOCUMENTS

DE 102010030223 A1 * 12/2011 ..... A45D 1/04
FR 3010284 B1 * 3/2017 ..... A45D 1/04
(Continued)

OTHER PUBLICATIONS

Collins Dictionary, Definition of Porous, Retrieved online May 21, 2021 (Year: 2021).*
(Continued)

*Primary Examiner* — Jacqueline T Johanas
*Assistant Examiner* — Sarah Woodhouse
(74) *Attorney, Agent, or Firm* — Oliff PLC

(57) ABSTRACT

The invention relates to a device for treating the hair and to the corresponding application method, the device (2) comprising: —two arms (5, 6) that are able to move relative to one another between a moved-together configuration for treating the hair and a spaced-apart configuration for inserting hair to be treated between said arms, and —a system (18) for applying a product, comprising an applicator member (26) for applying the product, the application system (18)
(Continued)

Figure 1:
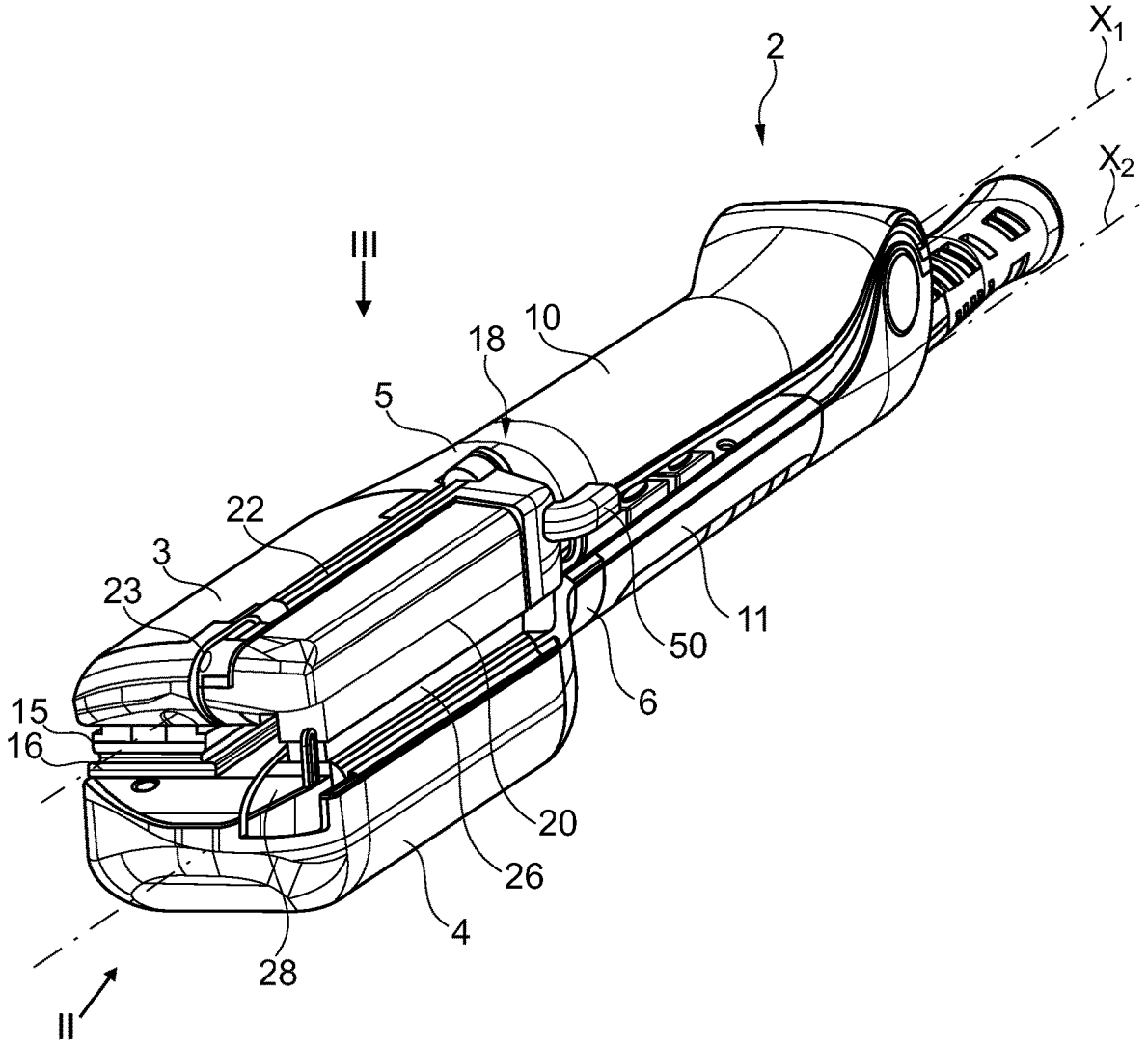

being mounted on one of the arms (5) and being able to move relative to said arm (5) between at least two positions generating, while the device (2) is being used to treat the hair, different respective application pressures of the applicator member (26) on the hair to be treated.

19 Claims, 6 Drawing Sheets

(51) Int. Cl.

| | |
|---|---|
| ***A45D 1/28*** | (2006.01) |
| *A45D 34/04* | (2006.01) |
| *A45D 24/00* | (2006.01) |
| *A45D 7/00* | (2006.01) |
| *A45D 34/00* | (2006.01) |

(52) U.S. Cl.
CPC ..... *A45D 34/04* (2013.01); *A45D 2007/002* (2013.01); *A45D 2034/005* (2013.01)

(58) Field of Classification Search
CPC ... A45D 1/00; A45D 1/04; A45D 1/06; A45D 1/14; A45D 1/08
USPC ..... 132/269, 108, 110, 221, 224, 227, 228, 132/229, 231, 232, 272
See application file for complete search history.

(56) References Cited

U.S. PATENT DOCUMENTS

| | | | | |
|---|---|---|---|---|
| 5,291,905 | A * | 3/1994 | Busch | A45D 19/02 132/114 |
| 10,485,319 | B2 * | 11/2019 | Fereyre | A45D 19/16 |
| 2003/0150126 | A1 * | 8/2003 | Chang | A45D 20/122 34/96 |
| 2006/0108344 | A1 * | 5/2006 | Kim | A45D 1/04 219/225 |
| 2006/0207625 | A1 * | 9/2006 | Chan | A45D 1/04 132/224 |
| 2008/0216859 | A1 | 9/2008 | Chan | |
| 2012/0272993 | A1 * | 11/2012 | Fereyre | A45D 2/001 132/221 |
| 2014/0048095 | A1 * | 2/2014 | Curry | A45D 19/0008 132/270 |
| 2014/0305457 | A1 * | 10/2014 | Blauser | A45D 24/04 132/114 |
| 2014/0332026 | A1 * | 11/2014 | Peters | A45D 19/0008 132/221 |
| 2015/0289622 | A1 * | 10/2015 | Fereyre | A45D 1/06 132/211 |
| 2016/0316881 | A1 * | 11/2016 | Fereyre | A45D 1/06 |
| 2016/0324291 | A1 * | 11/2016 | Fereyre | A45D 19/028 |

FOREIGN PATENT DOCUMENTS

| | | | | |
|---|---|---|---|---|
| JP | 2004255207 | A * | 9/2004 | A45D 1/18 |
| KR | 100 988 162 | B1 | 10/2010 | |
| WO | 2006/099522 | A2 | 9/2006 | |
| WO | 2009/078046 | A1 | 6/2009 | |
| WO | WO-2013153320 | A1 * | 10/2013 | A45D 1/04 |
| WO | 2014/064660 | A1 | 5/2014 | |
| WO | WO-2015097625 | A2 * | 7/2015 | A45D 1/04 |
| WO | WO-2015097627 | A1 * | 7/2015 | A45D 1/04 |

OTHER PUBLICATIONS

Mar. 23, 2016 International Search Report issued in International Patent Application No. PCT/EP2015/081252.

* cited by examiner

DEVICE FOR TREATING THE HAIR FOR CONTROLLING THE APPLICATION OF A PRODUCT

The present invention relates to a device for treating the hair, and more particularly, but not exclusively, those intended for shaping the hair, in particular those intended for straightening, curling or crimping the hair.

The invention relates more particularly to devices comprising two arms that are able to move with respect to one another, being able to take up a spaced-apart configuration for introducing a lock between said arms and a moved-together configuration for treating the lock, the arms being movable along the lock in this moved-together configuration. In such devices, the arms frequently carry two heating elements with which the hair is brought into contact during the use of the device.

BACKGROUND

Numerous devices of this type, sometimes also known as straightening irons, have already been proposed, implementing the application of a haircare product to the hair.

Usually, hair straighteners consist of two arms that are connected together with the aid of a hinge which makes it possible to open and close said arms, and of at least one heating element disposed on the arms. During operations of styling a lock of hair, said lock is introduced between the two arms in the open position and then the two arms are closed manually over the lock of hair. The lock of hair is then subjected to the heat output by the heating element, until the two arms are opened and the lock of hair is removed.

Application WO 2009/078046 describes a hairstyling appliance comprising two arms that are connected together so as to allow the appliance to be opened and closed, at least one heating member and at least one seat for accommodating a hair treatment device, the hair treatment device allowing a haircare product to be dispensed during operation. The hair treatment device is composed of a support material impregnated with a haircare product and suitable for a single use.

WO 2014/064660 describes a device for treating the hair, comprising two arms that are connected together to allow the appliance to be opened and closed, a reservoir containing a product to be applied, an applicator member for applying the product and a steam outlet for exposing the hair to the steam.

There is a need to further improve devices for applying a haircare product such that the user can easily control the application of cosmetic product while using the device.

SUMMARY

According to a first of its aspects, a subject of the invention is a device for treating the hair, comprising:

- two arms that are able to move relative to one another between a moved-together configuration for treating the hair and a spaced-apart configuration for inserting hair to be treated between said arms, and
- a system for applying a product, comprising an applicator member for applying the product, the application system being mounted on one of the arms and being able to move relative to said arm between at least two positions generating, while the device is being used to treat the hair, different respective application pressures of the applicator member on the hair to be treated.

The invention allows the user, while using the device, in particular when the two arms are in the moved-together configuration, to choose one or the other of said positions of the application system so as to apply more or less product.

Preferably, the two positions are extreme positions of the application system.

Preferably, one of the positions is a position moved towards the hair to be treated, for applying the product, and the other is a position spaced apart from the hair to be treated, in which the applicator member is spaced apart from the hair to be treated, in particular sufficiently spaced apart for the applicator member not to come into contact with the hair to be treated in the moved-together configuration of the arms. This allows the user to choose to stop or to start the application at any time during the use of the device. The user can, for example, choose to apply the product to certain locks of hair only; it is then not necessary for them to change the device or to remove the applicator member during the treatment of the hair. It is easy for the user to put the application system in the application position while treating certain locks of hair, and to put the application system in the spaced-apart position for the others. The user can also choose to apply the product to only a part of the hair, in particular the ends of the hair.

The application system can be configured to take up any intermediate position during the use of the device for treating the hair. The passage from one of the positions to the other can take place continuously such that the user can choose to keep the application system in an intermediate position so as to have notably a particular quantity of product applied.

The movement of the application system between the two positions can take place while the device is being used on the hair without it being necessary to stop treatment.

Preferably, each of the arms comprises a half-handle for holding the device and a jaw that comes into contact with the hair to be treated in the moved-together configuration of the arms. Preferably, the application system extends along the jaw of the arm which carries it. Preferably, the application system extends exclusively along the jaw.

The application system may be mounted in a depression in the arm which carries it, in particular in a depression in the jaw which carries it. The depression may be such that the width of the assembly formed by the jaw which carries the application system and the application system is more or less equal to the width of the other jaw.

The application system may comprise a holder mounted on the arm which carries it and a refill which is mounted on the holder and comprises the applicator member.

The refill may be removable; it may be fixed by complementing shapes, and in particular comprise a rib that can slide in a corresponding groove in the holder.

The holder and/or the refill may comprise a locking member for locking the refill to the holder, preventing said refill from accidentally detaching from the holder. The refill may be accessible, regardless of the position of the application system and the configuration of the arms. The refill may be removable in each of the positions of the application system, whether the arms are in the moved-together or spaced-apart configuration.

In top view, the refill, the holder and the arm which carries them can be visible. The expression "in top view" means that the device is observed from the side of the jaw away from the side that comes into contact with the hair to be treated.

The application system may comprise a lever or a pusher for moving the application system, preferably manually, between said positions.

The device may comprise a return spring for keeping the application system in one of said positions, in particular in the spaced-apart position.

The device may comprise at least one device for locking the application system in order to keep the latter in one of said positions, in particular in the application position.

The locking device may comprise a slider that is mounted on the arm which carries the application system, and locks the application system in one of said positions, in particular by being inserted into a notch in the application system, in particular in the holder.

The locking device may make it possible to lock the application system in at least two different positions. For example, the application system, in particular the holder, may comprise two separate notches that each correspond to a position of the application system, in particular to the application position and to an intermediate position between said positions, in particular in a reduced application position.

The device may comprise at least two devices for locking the application system, one of the locking devices making it possible to keep the system in one of said positions, in particular in the application position, and the other of the locking devices making it possible to keep the system in an intermediate position between said positions, in particular in a reduced application position.

The application system may be able to rotate about a rotation axis. The application system may be mounted on the arm which carries it by way of a pivot connection, in particular with the aid of a hinge. The pivot connection may be a connection between the arm, in particular the jaw, and the holder. The connection may be adjacent to the depression in the jaw which carries the application system, or disposed therein. The pivot connection preferably allows the application system to rotate about a rotation axis. The rotation axis may be parallel or perpendicular to the longitudinal axis of the arm which carries the application system. Preferably, the rotation axis is parallel to the longitudinal axis of the arm which carries the application system.

In a variant, the application system is able to move, in particular in translation, along an axis, in particular an axis perpendicular to the application surface of the applicator member that comes into contact with the hair to be treated.

The applicator member for applying cosmetic product comes into contact with the hair to be treated in at least one of said positions. The applicator member for applying cosmetic product is preferably porous and elastically compressible, and in particular is a felt comprising fibres that can all have substantially the same orientation. Preferably, the applicator member is saturated with product before it is mounted on the device.

The jaw opposite the one that carries the applicator member may define a counter-bearing surface such that, in at least one of said positions of the application system, the hair is pressed against the applicator member with a certain pressure by the counter-bearing surface. The counter-bearing surface may be formed by a pressing element disposed in a housing in the opposite jaw, in particular a pressing element that is removable from the housing.

Preferably, in particular when the hair is intended to be straightened, the device comprises a heating element intended to come into contact with the hair, and better still two heating elements that are intended to come into contact with the hair and are each disposed on an arm, in particular facing one another in the moved-together configuration of the arms. This or these heating element(s) may each comprise a plate, made of a material that is a good conductor of heat, that defines a hot surface for bringing into contact with the hair, the temperature of said surface being for example greater than or equal to 95° C., better still between 90 and 230° C.

One of the arms, and preferably the arm opposite the one that carries the application system, may have a steam outlet, and/or a comb.

Preferably, product is applied to the lock of hair introduced into the device prior to the application of steam and/or combing and/or straightening by the heating element(s). Thus, the hair introduced between the arms can come into contact with the applicator member before being exposed to the comb, to the steam and to the heating elements while the lock is being moved between the arms of the device.

Preferably, the device for treating the hair according to the invention is a straightener comprising at least two flat heating elements, in particular which come into contact with one another in the closed position.

A further subject of the invention is a method for treating the hair, wherein use is made of a device according to the invention, and wherein the position of the application system is varied relative to the arm which carries it, in particular in order to start applying a product, stop the application of the product, or modify the pressure exerted by the applicator member on the hair during the application of the product.

The position of the application system can be changed while the device is being used on the hair without it being necessary to stop treatment.

Figure 2:
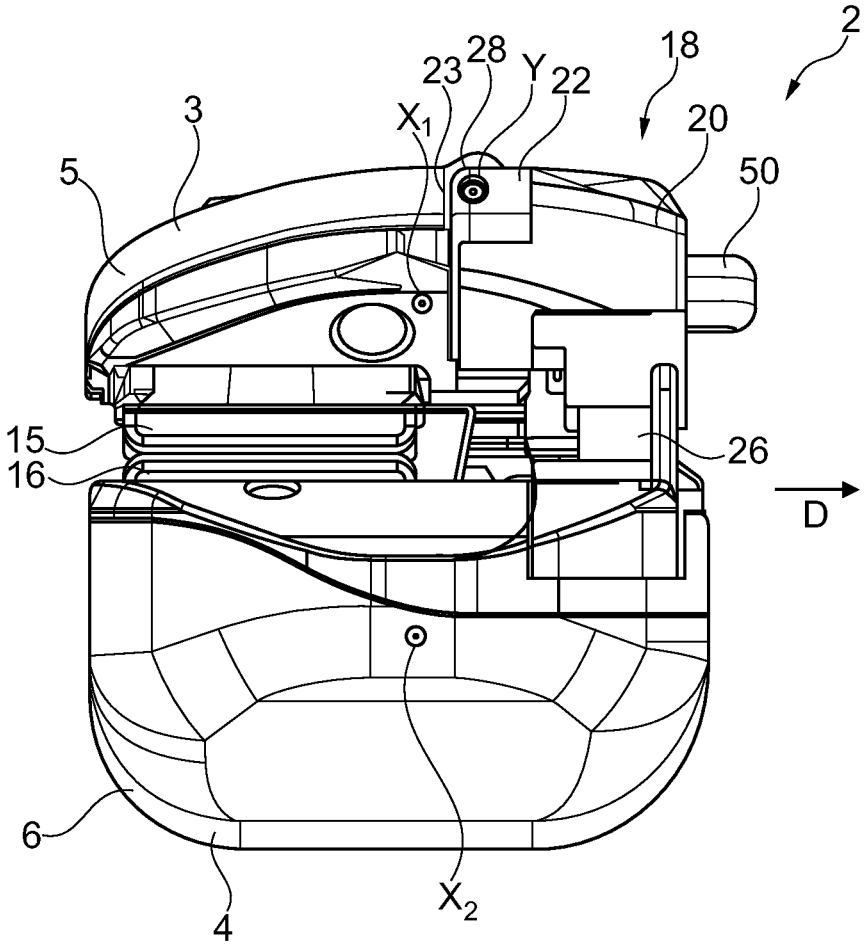
Figure 3:
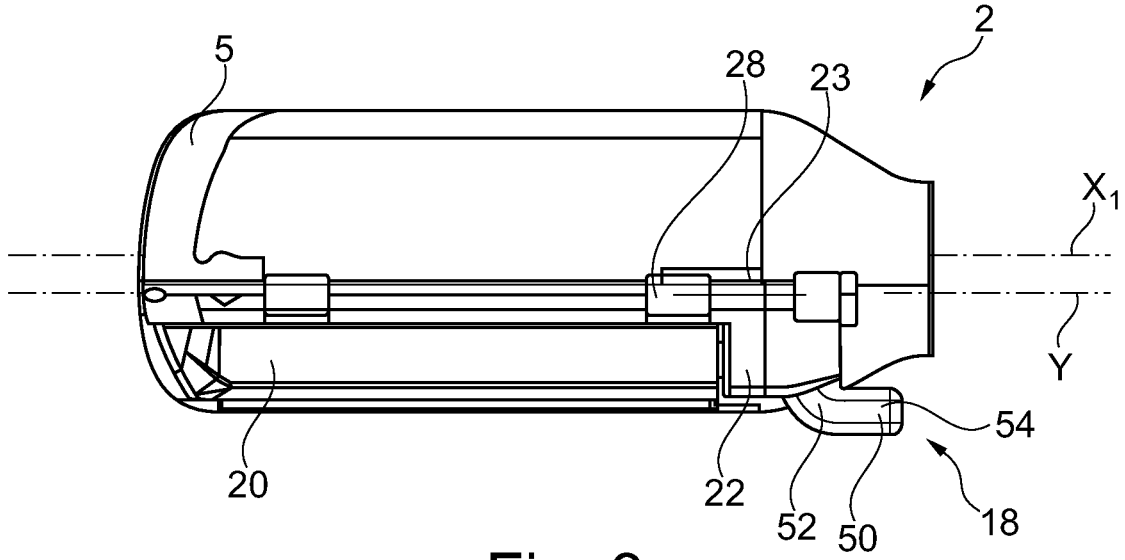
Figure 4:
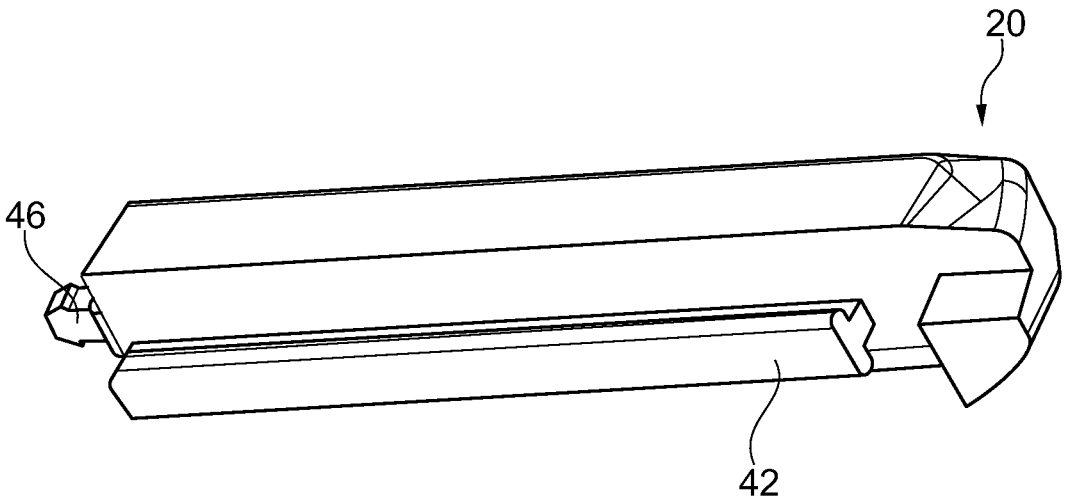
Figure 5:
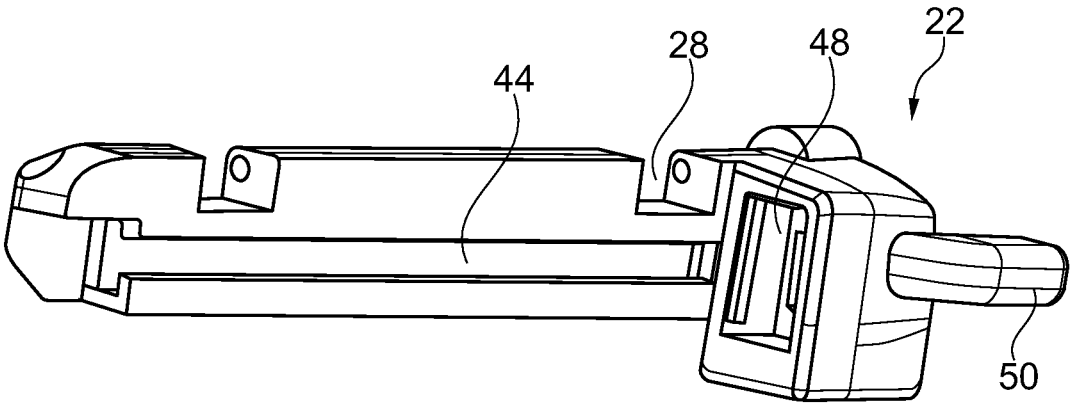
Figure 6:
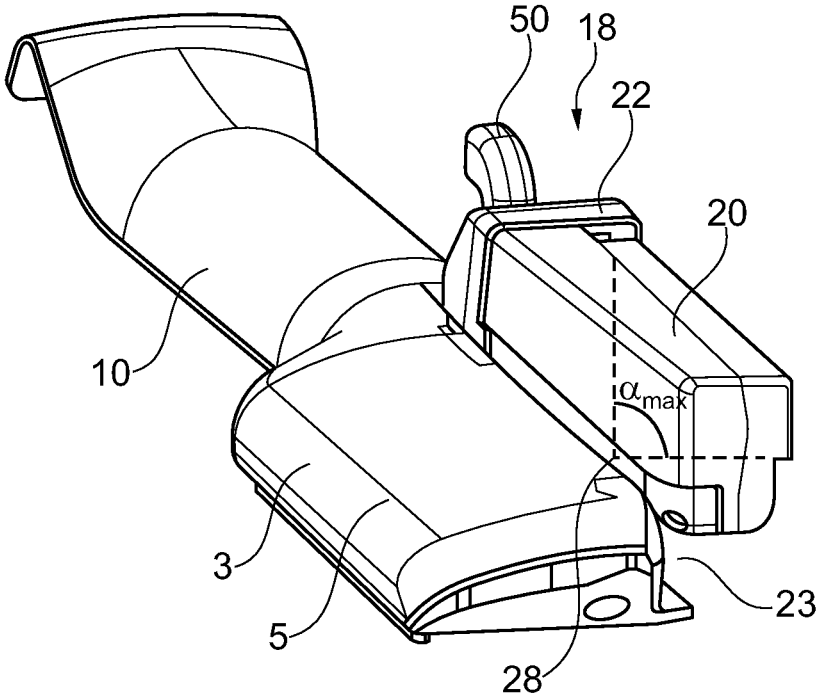
Figure 7:
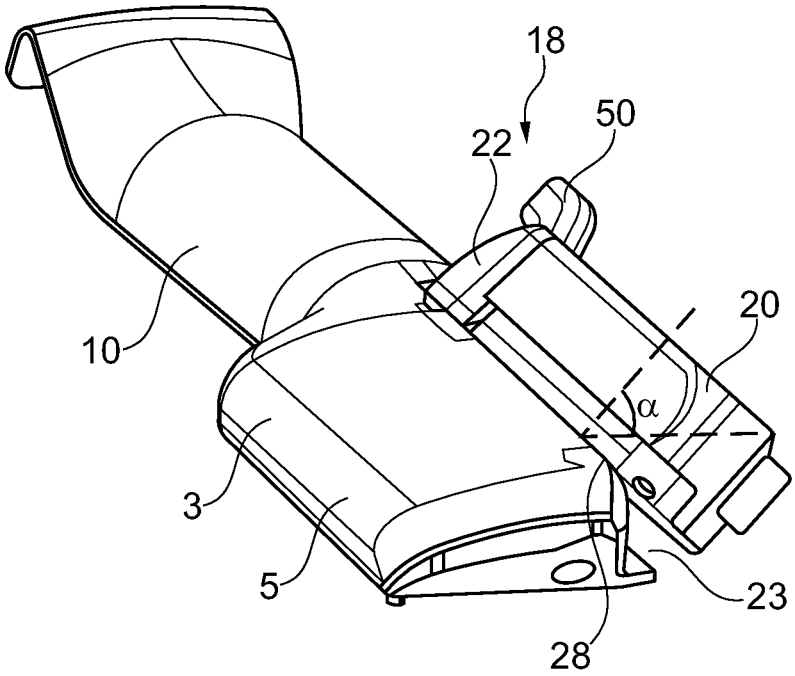
Figure 8:
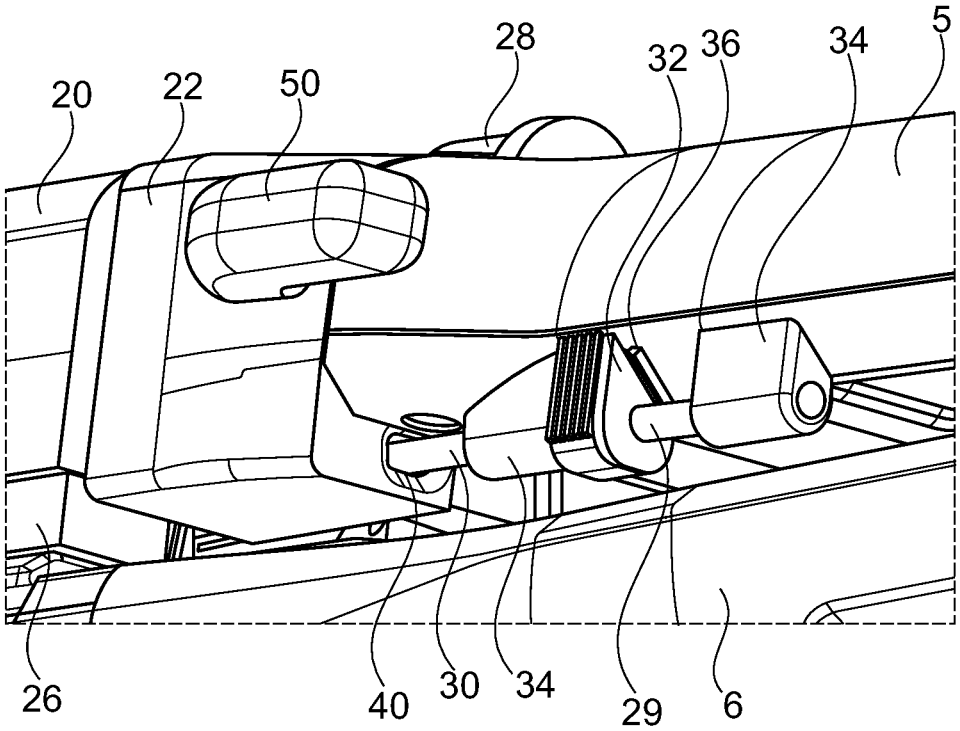
Figure 9:
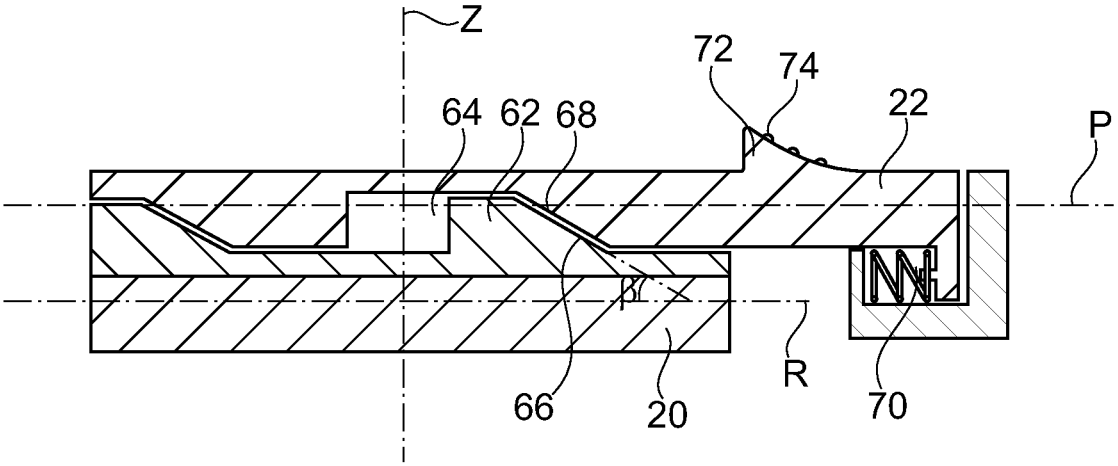
Figure 10:
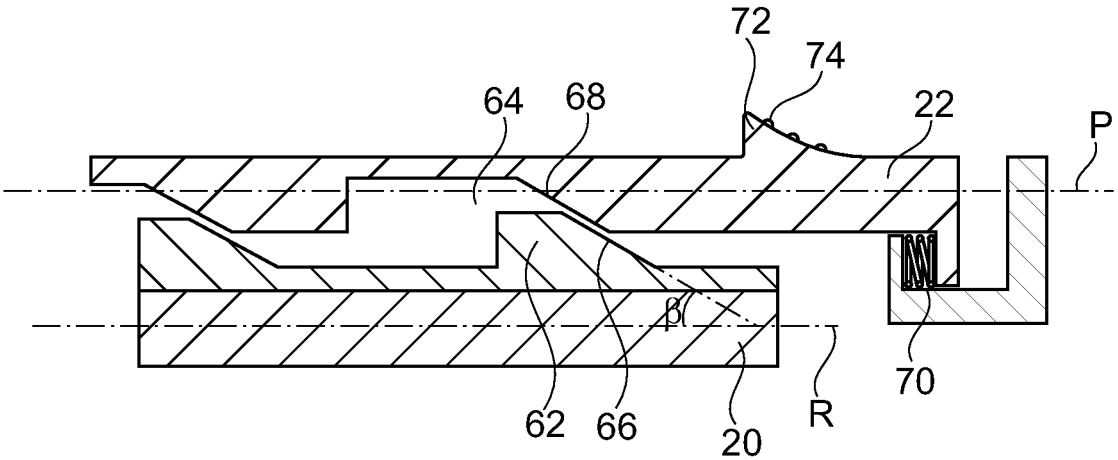

The invention may be better understood from reading the following detailed description of non-limiting illustrative embodiments thereof and from examining the appended drawing, in which:

FIG. 1 is a schematic perspective view of one example of a device, the application system being in the application position, FIG. 2 is a front view along II of the device in FIG. 1, FIG. 3 is a partial top view along III of the device in FIG. 1, FIG. 4 schematically shows a perspective view of one example of a refill, FIG. 5 shows a schematic perspective view of one example of a holder, FIG. 6 schematically illustrates an example of an arm carrying an application system, in the position spaced apart from the hair to be treated, FIG. 7 shows the arm from FIG. 4, the application system being in an intermediate position, FIG. 8 is a schematic depiction of an example of a device for locking the holder, FIG. 9 schematically shows a partial cross-sectional view of a variant application system in one of the two positions, and FIG. 10 shows the application system from FIG. 9 in the other of the two positions.

In the rest of the description, identical or similar elements or elements having identical or similar functions bear the same reference signs in the figures, unless stated otherwise.

FIGS. 1 to 3 show the handpiece 2 of an example of a device for treating the hair according to the invention.

This handpiece 2 has two jaws 3 and 4 that are able to move with respect to one another between a spaced-apart configuration (not shown) for introduction between said jaws of a lock of hair, and a moved-together configuration for treatment.

The jaws 3 and 4 are carried by an upper arm 5 and a lower arm 6, respectively, which, in the example in question, are connected together at one end by an articulation 8, the handpiece 2 thus forming tongs.

The upper arm 5 and lower arm 6 each preferably have a total length of between 22 cm and 40 cm, in particular around 31 cm, defining, between the articulation 8 and the jaws 3 and 4, respective half-handles 10 and 11 on which the user can press in order to move the jaws 3 and 4 together.

The upper arm 5 and lower arm 6 extend along respective longitudinal axes $X_1$ and $X_2$ which are preferably parallel to one another when the jaws 3 and 4 are closed.

An elastic return member (not visible) is preferably provided to return the jaws 3 and 4 to a spaced-apart configuration, this elastic return member being for example a spring disposed around an articulation pin 8.

The invention is not limited to a particular manner of connecting the upper arm 5 and lower arm 6 together and the jaws 3 and 4 may be rendered able to move in some other way without departing from the scope of the present invention. However, the presence of an articulation is largely preferred for the ergonomics it provides.

The jaws 3 and 4 define between one another a region for treating the hair, said region being intended to receive a lock of hair to be treated, the handpiece 2 being moved along said lock during the treatment, for example in the direction from the root to the end of the hair.

In the example in question, the handpiece 2 is configured to apply a cosmetic product, and then to comb the hair by passing through a comb (not shown), to treat the hair by way of steam and then to carry out a heat treatment of the hair by contact with two hot surfaces 15 and 16.

The direction D of movement of the handpiece 2 over the hair, illustrated in FIG. 2, is preferably substantially perpendicular to the upper arm 5 and lower arm 6.

The handpiece 2 is connected by a line, in the example in question, to a base station (not shown) that is fixed during the treatment and is connected to the mains.

This base station provides the electric power supply to the handpiece 2 and also its supply with water in order to generate steam, and may also carry out additional functions of processing electrical signals received from the handpiece 2. The line 18 which connects the handpiece 2 to the base station can thus comprise various electrical conductors and a water supply pipe.

A user interface (not shown in the figures) can be present on the handpiece 2 so as to allow the user for example to start up certain components thereof, or not.

The cosmetic product is applied by an application system 18 comprising a refill 20 that contains the cosmetic product and a holder 22 that carries the refill 20 and is mounted on one of the two arms, 5 or 6, in this case the upper arm 5. The application system 18 is housed in a depression 23 in the arm 5.

The refill 20 comprises an applicator member 26 that contains the cosmetic product and can come into contact with the hair to be treated.

In the example illustrated in FIGS. 1 to 3, the applicator member 26 faces a pressing element 28 carried in a housing in the other of the arms 6, against which the applicator member 26 can press the hair to be treated. The pressing element 28 has a surface for contact with the hair having a shape complementary to the application surface of the applicator member 26 with which the hair to be treated comes into contact. The pressing element 28 may be removable and comprise a handle that makes it possible in particular to remove the latter from its housing.

As illustrated in FIG. 4, the refill 20 comprises a relief, in particular a groove 42, in this case a T-shaped groove, which cooperates with a corresponding relief on the holder 22, and in particular slides in a rib 44 corresponding to the groove 42, as illustrated in FIG. 5, making it possible to mount the refill 20 on the holder 22.

The refill 20 also comprises the male part 46 of a locking member that cooperates with the female part 48 of a locking member on the holder 22, making it possible to keep the refill 20 on the locking member, regardless of the orientation of the device 2.

In a variant, the refill comprises the female part of the locking member and the holder comprises the corresponding male part.

The holder 22 is articulated about a rotation axis Y which is oriented substantially parallel to the longitudinal axis $X_1$ of the upper arm 5 between an open position in which the applicator member 26 is spaced apart from the lock to be treated and a closed position in which the applicator member 26 can come into contact with the hair to be treated.

The holder 22 is for example articulated by way of a hinge 28, as illustrated in FIGS. 1 to 3 and 6 and 7, to the distal part of the arm 5 which acts as a jaw 3 while the handpiece 2 is being used. The holder 22 can pivot from a moved-together application position, in which the application surface of the applicator member 26 is approximately parallel to the other of the arms 6 in the moved-together configuration, to a spaced-apart position, in which the application surface of the applicator member 26 is spaced apart from the hair.

The maximum angular travel $\alpha_{max}$ of the holder 22, illustrated in FIG. 6, is advantageously at least 45°, better still at least 90°, as illustrated in FIG. 6, in order to space the applicator member 26 apart from the hair to be treated. As illustrated in FIG. 7, the holder 22 can also take up any intermediate position between the moved-together application position and the spaced-apart position.

In the example illustrated in FIGS. 1 to 8, the holder 22 comprises a lever 50 that protrudes laterally from the latter. The lever 50 allows the user to pivot the holder 22 about its rotation axis Y. The lever 50 has an angled portion 52 that is connected to a side wall of the holder 22, and a straight portion 54 that extends substantially along an axis parallel to the rotation axis Y.

The closing or opening movement of the holder 22 may, if appropriate, be assisted by an elastic return member, for example a helical spring or leaf spring disposed in the region of the hinge 28. This return member can urge the holder 22 towards its open position.

The use of such a return member is particularly advantageous when the device is also equipped with a device 28 for locking the holder 22 in the closed position, as illustrated in FIG. 8. In this case, when the user acts on this locking device 29 in order to unlock the holder 22, the latter can be opened automatically, advantageously as far as its completely open position or, in a variant, over only a part of the opening travel.

As illustrated in FIG. 8, the locking device 29 comprises a slider 30 mounted on the arm 5 which carries the support 22, in particular inserted into at least two guides 34 of the arm 5, a manipulating member 32 fixed to the slider 30, in particular between the guides 34 of the arm 5, and a blocking relief 36 present on the arm, in particular between the two guides 34. The slider 30 is intended to be inserted into a notch 40 in the holder 22 in order to lock the latter in the closed position. The manipulating member 32 can be moved between the two guides 34 and bear against the latter. It is secured to the slider 30, with the result that the movement of the manipulating member 32 between the two guides 34 causes the slider 30 to move in the guides 34, thereby allowing said slider to be inserted into or removed from the notch 40. The blocking relief 36 is disposed on the arm 5 such that, in the locked position, the manipulating member 32 is locked between the latter and one of the guides 34. This can reduce the risk of the holder 22 opening accidentally if the handpiece 2 is dropped, for example.

In order to lock the holder 22 in the closed position, the user manually holds the latter in the closed position, in particular with the aid of the lever 50, and moves the manipulating member 32 against the guide 34 closest to the holder 22, passing over the blocking relief 36. In order to unlock the holder 22, the user moves the manipulating member 32 against the guide 34 furthest from the holder 22, passing back over the blocking relief 36.

The holder 22 can comprise a plurality of notches 40 that each make it possible to keep the latter at a particular angular travel $\alpha$; for example, one of the notches 40 makes it possible to keep the holder 22 in the moved-together application position, and another of the notches 40 makes it possible to keep the holder 22 in the half-open position, as illustrated in FIG. 7.

It is possible to provide the holder 22 with a movement retarder when the hinge 28 is equipped with an elastic return member.

The example illustrated in FIGS. 9 and 10 differs from the one in FIGS. 1 to 8 by way of the shape of the application system 18.

In the example illustrated in FIGS. 9 and 10, the application system 18 comprises a refill 20 that is able to move along an axis Z perpendicular to the application surface of the applicator member 26, and a holder 22 that is able to move along an axis P parallel to the axis $X_1$ of the arm 5. The refill is fixed along the axis P and the holder 22 is fixed along the axis Z. The refill 20 comprises protrusions 62 that are housed in complementary recesses 64 in the holder 22. The protrusions 62 have a substantially planar face 66 that forms an angle $\beta$ of between 5° and 60° with the longitudinal axis R of the refill 20. The face 66 is in contact with a substantially planar wall 68 of the corresponding recess 64, at the same angle $\beta$ with the longitudinal axis R. In this way, as illustrated in FIG. 10, the movement along the axis P of the holder 22 causes the face 66 to slide against the wall 68, which moves the refill 20 along the axis Z.

The applicator member 26 can thus be spaced apart or moved towards the other of the arms 6 in order to be able to control the quantity of cosmetic product applied to the hair to be treated.

The holder 22 comprises a return member 70 that makes it possible to return the latter into one of the positions, in particular a position spaced apart from the hair to be treated.

The holder 22 comprises a pusher 72 having reliefs 74. The latter make it possible for the user to grip the pusher 72 with their finger.

The invention is not limited to the exemplary embodiments which have just been described, and the characteristics of the various examples can be combined with one another within variants that are not illustrated.

The expression "comprising a" should be understood as being synonymous with "comprising at least one", unless specified to the contrary.

The invention claimed is:

1. Device for treating the hair, comprising:

two arms that are able to move relative to one another between a moved-together configuration for treating the hair and a spaced-apart configuration for inserting hair to be treated between said arms, two heating elements that are each intended to come into contact with the hair and are each disposed on an arm, and an application system for applying a cosmetic product, comprising a holder and a refill which is mounted on the holder and comprises an applicator member made of a porous material and being soaked with the cosmetic product for applying the cosmetic product in a liquid form on the hair while contacting the hair in the moved-together configuration of the two arms, the application system being mounted on one of the arms, and the holder being able to move relative to said arm between at least two positions generating, while the two arms are in the moved together configuration, different respective application pressures of the applicator member on the hair to be treated, the arm opposite to the arm on which the application system is mounted comprising a counter bearing surface such that, in at least one position of the holder of the application system, the hair is pressed against the applicator member with a certain pressure by the counter bearing surface while the device is being used to treat the hair, wherein a surface of the applicator member configured to contact the hair being continuous.

2. Device according to claim 1, wherein one of the at least two positions generating different application pressures while the two arms are in the moved-together configuration is a contact position for applying the cosmetic product on the hair, and another one of the at least two positions generating different application pressures while the two arms are in the moved-together configuration is a position without contact with the hair to be treated, in which the applicator member is spaced apart from the hair to be treated.

3. Device according to claim 1, wherein the application system can take up any intermediate position during the use of the device for treating the hair.

4. Device according to claim 1, wherein each of the arms comprises a half-handle for holding the device and a jaw that comes into contact with the hair to be treated in the moved-together configuration of the arms, the application system extending along the jaw of the arm which carries it.

5. Device according to claim 4, wherein the application system extends exclusively along the jaw.

6. Device according to claim 1, wherein the application system is mounted in a depression in the arm which carries it.

7. Device according to claim 1, wherein the refill is removable and is fixed by complementing shapes.

8. Device according to claim 1, wherein the refill is accessible regardless of the configuration of the arms and the position of the application system.

9. Device according to claim 1, wherein the refill is removable in each of the positions of the application system, whether the arms are in the moved-together or spaced-apart configuration.

10. Device according to claim 1, wherein the application system comprises a lever or a pusher for moving the application system between said positions.

11. Device according to claim 1, which comprises a return spring for keeping the application system in one of said positions.

12. Device according to claim 1, which comprises at least one locking device for locking the application system in order to keep the latter in one of said positions.

13. Device according to claim 12, wherein the locking device comprises a slider that is mounted on the arm which carries the application system, and locks the application system in one of said positions.

14. Device according to claim 12, wherein the locking device makes it possible to lock the application system in at least two different positions.

15. Device according to claim 1, wherein the application system is mounted on the arm which carries it by way of a pivot connection.

16. Device according to claim 15, wherein the arm carrying the application system has a longitudinal axis, the pivot connection allowing the application system to rotate about a rotation axis parallel to the longitudinal axis of the arm which carries the application system.

17. Device according to claim 1, wherein the application system is able to move along an axis.

18. Method for treating the hair, wherein use is made of a device as defined in claim 1, and wherein the position of the application system is varied relative to the arm which carries it.

19. Device according to claim 1, wherein the counter bearing surface has a shape complementary to an application surface of the applicator member with which the hair to be treated comes into contact.

* * * * *